United States Patent [19]

Mitchell

[11] 4,010,730

[45] Mar. 8, 1977

[54] FIREPLACE SHIELD

[76] Inventor: Terry L. Mitchell, Rte. 3, Loganville, Ga. 30249

[22] Filed: June 11, 1975

[21] Appl. No.: 585,790

[52] U.S. Cl. ..... 126/140; 126/202; D7/208

[51] Int. Cl.[2] ..... F24C 15/10

[58] Field of Search ..... 126/138, 140, 202; D7/206, 208

[56] References Cited

UNITED STATES PATENTS

| | | | |
|---|---|---|---|
| 588,146 | 8/1897 | Havecotte | 126/202 |
| 1,670,995 | 5/1928 | Sutton | 126/202 |
| 1,917,365 | 7/1933 | Goerz et al. | 126/202 |
| 3,789,825 | 2/1974 | Reiner | 126/140 |

*Primary Examiner*—Ronald C. Capossela
*Attorney, Agent, or Firm*—Walter M. Rodgers; Walter A. Rodgers

[57] ABSTRACT

A shield adapted for use in conjunction with a fireplace having a front opening. The shield comprises a front panel, a pair of side panels disposed respectively at the ends of the front panel and extending generally transverse to the front panel, and the lower portion of the front panel being spaced from the opening of the fireplace a greater distance than the upper portion of the front panel when the shield is disposed adjacent the opening.

2 Claims, 6 Drawing Figures

FIREPLACE SHIELD

In general various types of covers, fronts and shields have been provided for the typical home fireplace and experience with known fireplace shields has exposed various shortcomings. First of all most shields are not easily removable as they require permanent installation and naturally cause permanent damage to the fireplace facing due to the need for securely affixing the shield to the fireplace masonry. Another drawback to these shields is that they tend to be very expensive due to the inherent nature of their permanency. In addition known shields become very hot due to the proximity of the flame in the fireplace which causes a hazard especially to small children if they should accidently come in contact with the hot shield and also causes deterioration of the paint covering the shields.

According to this invention a fireplace shield is provided for use in combination with a fireplace having a front opening, the shield comprising a front panel, a pair of side panels disposed respectively at the ends of said front panel and extending generally transverse to said front panel, and the lower portion of the front panel being spaced from the opening a greater distance than the upper portion of the front panel when the shield is disposed adjacent the opening.

For a better understanding of this invention, reference may be had to the following detailed description taken in conjunction with the accompanying drawing in which FIG. 1 is a perspective view of a fireplace shield spaced from the fireplace opening;

FIG. 5 is a side view of the fireplace shield; and in which

Figure 1:
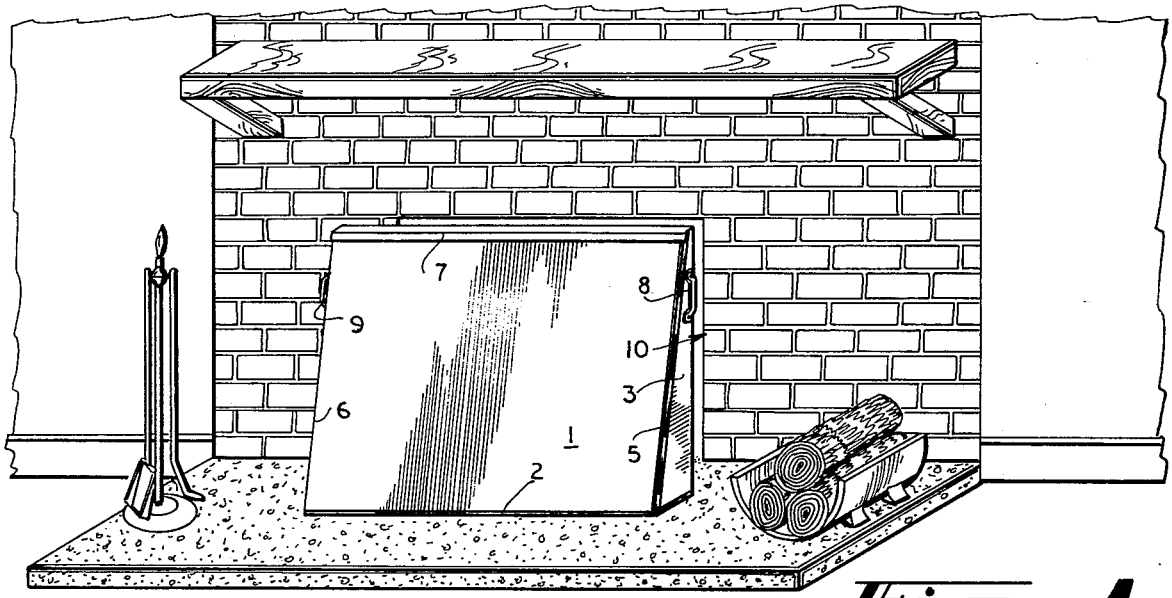
Figure 2:
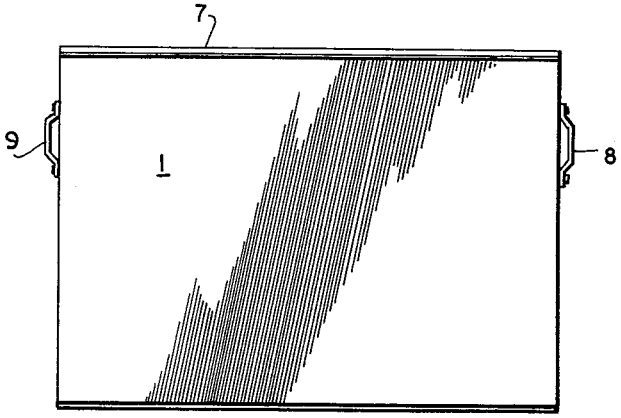
FIG. 2 is a front view of the fireplace shield shown in FIG. 1.

In the drawing the numeral 1 designates the front panel of a fireplace shield which is interconnected along a lower edge thereof to base 2. Additionally front panel 1 is interconnected along each side edge thereof respectively to the front edges of said side panels 3 and 4 by means of gastight reinforcing seams 5 and 6 each comprising face contacting strips integral respectively with said front and side panels.

Figure 5:
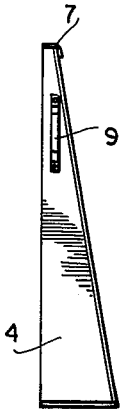
Figure 3:
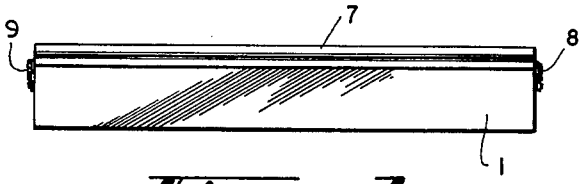
FIG. 3 is a top view of the fireplace shield.
Figure 4:
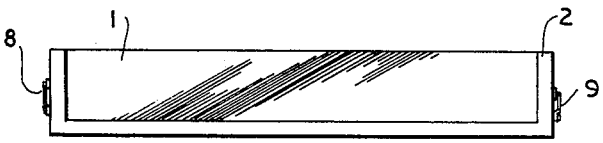
FIG. 4 is a bottom view of the fireplace shield.
Figure 6:
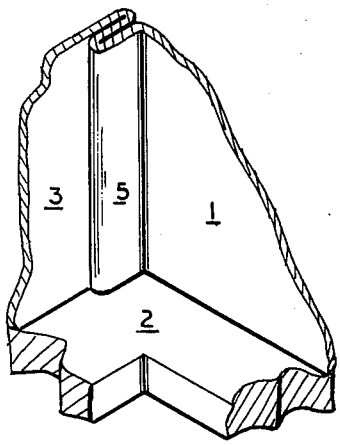
FIG. 6 shows a broken away portion of one corner of a fireplace shield constructed according to this invention.

In order to provide additional stabilization for this invention, a top piece 7 is provided, a portion of which is disposed in overlapping face contacting relation with the uppermost portion of front panel 1, as best shown in FIG. 5. In addition the ends of top piece 7 are interconnected with side panels 3 and 4 by any suitable means such as welding. In order to provide a fireplace shield which is easily and quickly movable, handles 8 and 9 are provided and are secured to side panels 3 and 4 respectively.

As depicted in FIG. 1, a fireplace shield constructed according to this invention is adapted to be used in conjunction with a fireplace having an opening which is shown generally at 10. Therefore to install the fireplace shield, handles 8 and 9 are manually grasped and the shield itself is placed in flush contact with fireplace opening 10. When the fire is no longer in operation, the fireplace shield is easily and simply removed due to its lightweight construction and non-permanent attachment to the fireplace.

Therefore, by this invention a fireplace shield is provided which has the beneficial characteristics of being pleasing in appearance, economical to construct, and easily removable. In addition it can be seen that when an active fire is not being closely attended, a safe condition is created by eliminating the possibility of a hot log rolling out of the fireplace and causing a disastrous fire. Also this invention eliminates the expensive problem of interior heat loss through an open fireplace chimney after the fire has diminished. An additional inherent feature of this invention is the fact that since the fireplace shield completely covers the fireplace opening it is held tightly in place due to the natural drafting effect of an active fire. Therefore this feature aids in the elimination of the requirement for permanent installation of the shield.

According to one aspect of this invention, the lower portion of the shield is spaced from the fire and therefore in naturally cooler. This prevents severe burns should the shield be accidently touched. Also the inwardly disposed angle of the front panel facilitates the elimination of smoke by directing the smoke in an upward direction.

The embodiments of the invention in which an exclusive property or privilege is claimed are defined as follows:

1. A shield for use in combination with a fireplace having a front opening, said shield comprising a front panel, a pair of side panels disposed respectively at the ends of said front panel and extending generally transverse to said front panel, the side edges of said front panel interconnected respectively with the edges of said pair of side panels remote from said opening by means of a gastight reinforcing seam, each of said reinforcing seams having a strip integral with a side edge of said front panel and another face contacting strip integral with the adjacent edge of the corresponding side panel, a base interconnected with the lower edges of said front panel and said pair of side panels, a top piece interconnected with the upper edges of said front panel and said pair of side panels, and the lower portion of said front panel being spaced from said opening a greater distance than the upper portion of said front panel when said shield is disposed adjacent said opening, said shield being effective to eliminate discharge of heated room air through said opening.

2. A shield according to claim 1 wherein a pair of handles are secured respectively to said pair of side panels.

* * * * *